US007097132B2

(12) United States Patent
Banks et al.

(10) Patent No.: US 7,097,132 B2
(45) Date of Patent: Aug. 29, 2006

(54) APPARATUS AND METHOD FOR SELECTIVITY LOCKING A FIN ASSEMBLY

(75) Inventors: Johnny E. Banks, Venus, TX (US); Brian C. Baker, Arlington, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 279 days.

(21) Appl. No.: 10/244,323

(22) Filed: Sep. 16, 2002

(65) Prior Publication Data

US 2004/0050997 A1 Mar. 18, 2004

(51) Int. Cl.
*F42B 15/01* (2006.01)

(52) U.S. Cl. ..... 244/3.29; 244/3.27

(58) Field of Classification Search ..... 244/3.28, 244/3.27, 3.24, 3.23, 49
See application file for complete search history.

(56) References Cited

U.S. PATENT DOCUMENTS

| | | | | | |
|---|---|---|---|---|---|
| 3,273,500 | A | * | 9/1966 | Kongolbeck | 244/3.28 |
| 3,304,030 | A | | 2/1967 | Weimholt et al. | 244/3.28 |
| 3,563,495 | A | * | 2/1971 | Korn | 244/3.29 |
| 4,323,208 | A | * | 4/1982 | Ball | 244/3.28 |
| 4,453,728 | A | * | 6/1984 | Verge | |
| 4,588,146 | A | * | 5/1986 | Schaeffel et al. | 244/3.27 |
| 4,673,146 | A | * | 6/1987 | Inglis | 244/3.23 |
| 4,778,127 | A | | 10/1988 | Duchesneau | 244/3.29 |
| 4,884,766 | A | | 12/1989 | Steinmetz et al. | 244/3.27 |
| 5,326,049 | A | * | 7/1994 | Rom et al. | 244/3.28 |
| 5,582,364 | A | | 12/1996 | Trulin et al. | 244/3.29 |
| 5,820,072 | A | * | 10/1998 | Na et al. | 244/49 |
| 5,950,963 | A | | 9/1999 | Speicher et al. | 244/3.21 |
| 6,092,264 | A | | 7/2000 | Banks | 16/321 |
| 6,250,584 | B1 | | 6/2001 | Hsu et al. | 244/3.24 |
| 6,352,217 | B1 | | 3/2002 | Hsu et al. | 244/3.24 |

FOREIGN PATENT DOCUMENTS

| | | |
|---|---|---|
| GB | 2140136 A | 11/1984 |
| JP | 02143097 A | 6/1990 |

* cited by examiner

*Primary Examiner*—Peter M. Poon
*Assistant Examiner*—Timothy D. Collins
(74) *Attorney, Agent, or Firm*—Daren C. Davis; James E. Walton

(57) ABSTRACT

A fin assembly includes a fin base, a fin tip rotatably connected with the fin base, and means for selectively locking the fin tip in a chosen configuration. A vehicle includes a body defining a cavity therein and defining an opening through a wall thereof, a fin control mechanism disposed within the cavity, and a fin base having an axle extending through the opening and engaged with the fin control mechanism. The vehicle further comprises a fin tip rotatably connected with the fin base, and means for selectively locking the fin tip in a chosen configuration. A method for configuring a fin assembly on a vehicle includes providing a fin tip rotatably connected with a fin base being operably coupled with the vehicle and selectively locking the fin tip in a first position relative to the fin base.

20 Claims, 5 Drawing Sheets

APPARATUS AND METHOD FOR SELECTIVITY LOCKING A FIN ASSEMBLY

BACKGROUND OF THE INVENTION

1. Field of the Invention

This invention relates to an apparatus and method for selectively locking a fin assembly in a chosen configuration. In one aspect, the invention relates to an apparatus and method for selectively locking a fin assembly in a folded configuration.

2. Description of the Related Art

Airborne and sea-going vehicles are often used to deliver a payload to a target location or to carry the payload over a desired area. For example, rockets, missiles, torpedoes, and other projectiles may be used in combat situations to deliver explosive warheads, kinetic energy penetrators, or other payloads to destroy or disable the target. Surveillance vehicles may carry a payload designed to sense certain conditions surrounding the vehicle, such as objects on the ground or weather conditions.

Such vehicles may include a plurality of fins for controlling their trajectories during flight. As the vehicle travels through the air or water, the attitude of the fins is adjusted to change the flight path of the vehicle. In the interest of space economy, however, it is generally desirable for the vehicle to be stored with its fins folded prior to its deployment. For example, a projectile's fins may be folded so that the diameter of the firing tube from which the projectile is deployed may be smaller than otherwise required. Accordingly, a mechanism is needed to hold each of the fins in the folded configuration and to release each of the fins so that they may unfold into an operational configuration.

Conventional fins may be retained in their folded configuration by some type of mechanism external to the projectile, such as a wire, a band, or a hook. In many cases, the mechanism is released from the projectile body after the fins are unfolded, thus presenting a potential debris problem for the surrounding environment. Further, some launch tubes employ additional fin restraint devices that are ejected after the projectile leaves the launch tube. These restraint devices also pose problems for the surrounding environment, as they may impact the launch platform or other surrounding equipment.

The present invention is directed to overcoming, or at least reducing, the effects of one or more of the problems set forth above.

SUMMARY OF THE INVENTION

In one aspect of the present invention, a fin assembly is provided. The fin assembly includes a fin base, a fin tip rotatably connected with the fin base, and means for selectively locking the fin tip in a chosen configuration.

In another aspect of the present invention, a fin assembly is provided. The fin assembly includes a fin base, a fin tip rotatably connected with the fin base, and a selectively operable lock operably coupled to the fin base and the fin tip, and capable of locking the fin assembly in a chosen configuration.

In yet another aspect of the present invention, a vehicle is provided. The vehicle includes a body defining a cavity therein and defining an opening through a wall thereof, a fin control mechanism disposed within the cavity, and a fin base having an axle extending through the opening and engaged with the fin control mechanism. The vehicle further comprises a fin tip rotatably connected with the fin base, and means for selectively locking the fin tip in a chosen configuration.

In another aspect of the present invention, a method for configuring a fin assembly on a vehicle is provided. The method includes providing a fin tip rotatably connected with a fin base being operably coupled with the vehicle and selectively locking the fin tip in a first position relative to the fin base.

In yet another aspect of the present invention, an apparatus is provided. The apparatus includes a fin tip rotatably connected with a fin base being operably coupled with the vehicle and means for selectively locking the fin tip in a first position relative to the fin base.

BRIEF DESCRIPTION OF THE DRAWINGS

The invention may be understood by reference to the following description taken in conjunction with the accompanying drawings, in which the leftmost significant digit(s) in the reference numerals denote(s) the first figure in which the respective reference numerals appear, and in which.

Figure 1:
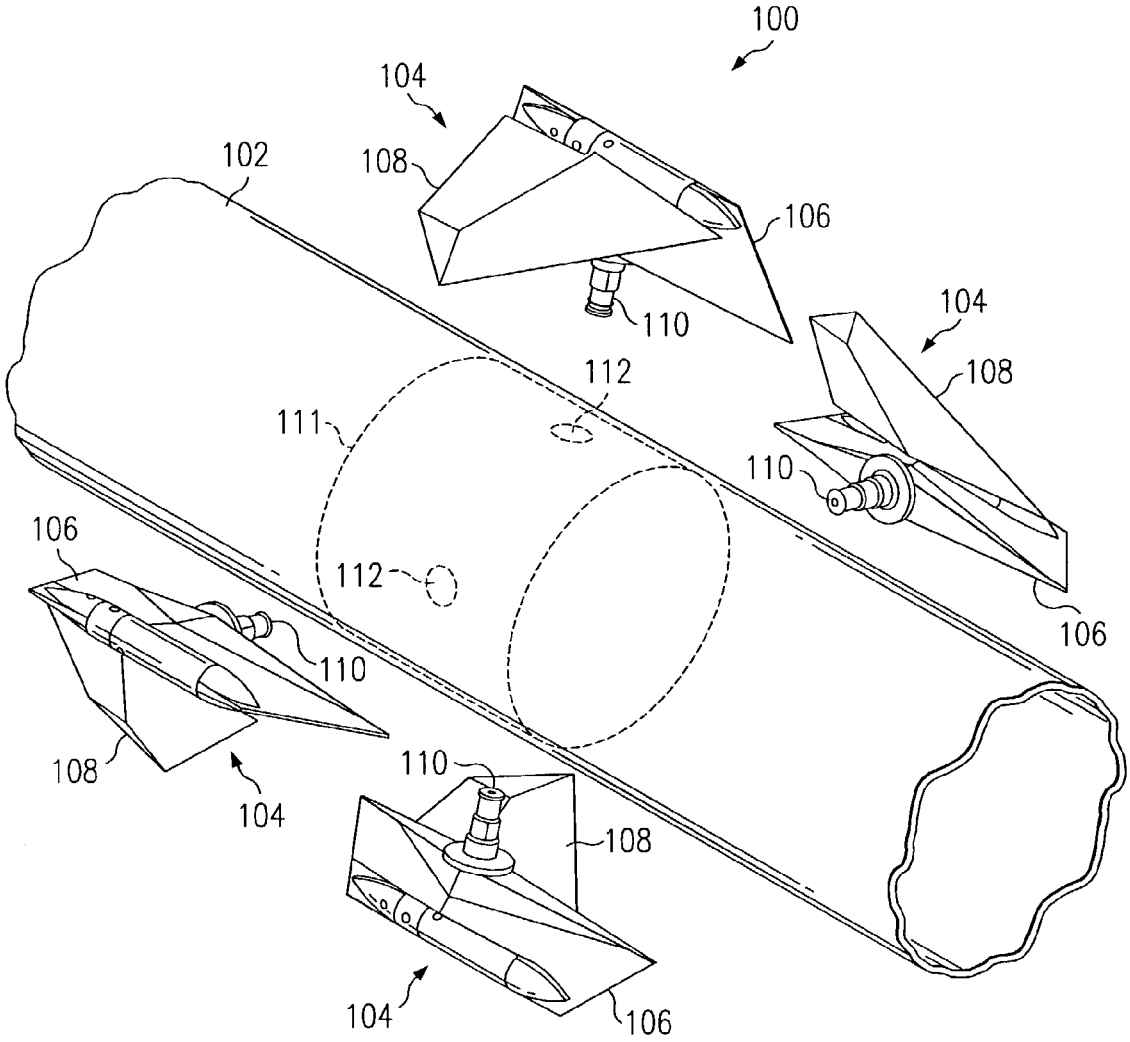
FIG. 1 is a partially exploded, perspective view of a projectile in one particular embodiment of the present invention, wherein a plurality of fin assemblies is illustrated in a folded configuration.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

FIG. 1 illustrates a projectile 100 according to the present invention including a body 102 (only partially illustrated in FIG. 1 for clarity) and one or more fin assemblies 104. While the present invention is described herein in relation to a projectile (e.g., the projectile 100), the scope of the present invention encompasses any air- or sea-going vehicle, including a projectile, a rocket, a missile, a torpedo, a surveillance vehicle, a drone, or the like. It is generally desirable for the fin assemblies 104 to be stowed in a folded configuration (as illustrated in FIG. 1) prior to deployment to conserve the overall space needed to store and transport the projectile 100. Thus, each fin assembly 104 is folded for transport and/or storage.

Figure 2:
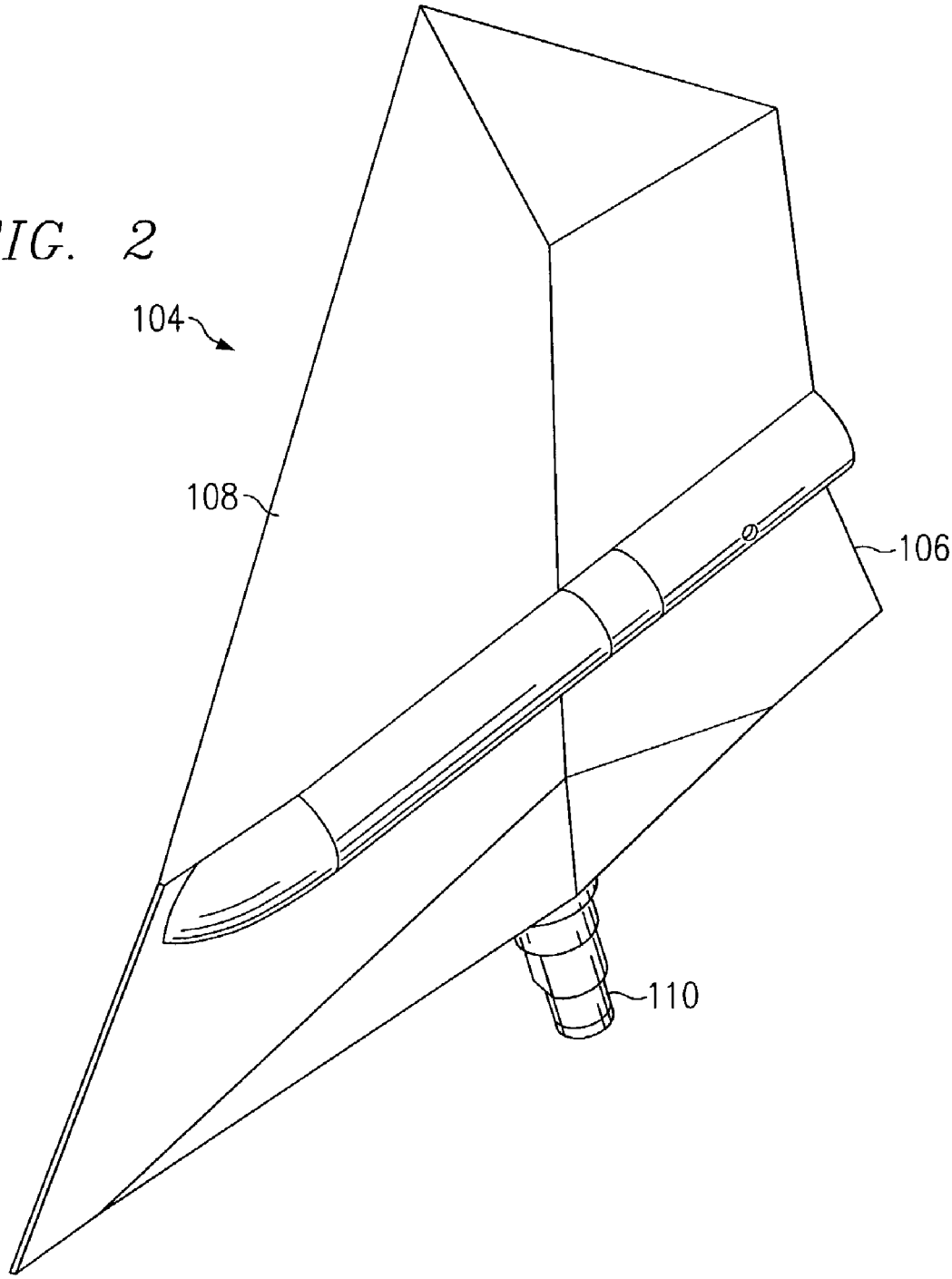
FIG. 2 is a perspective view of one of the fin assemblies shown in FIG. 1 in an unfolded, operational configuration.

Each of the fin assemblies 104 includes a fin base 106 and a fin tip 108 rotatably connected with the fin base 106. Upon deployment of the projectile, the fin tip 108 is rotated from the folded position, as illustrated in FIG. 1, to an unfolded, operational position, as illustrated in FIG. 2. The fin tip 108 may be then locked in the unfolded position by any means known to the art.

Referring now to FIG. 1, each of the fin assemblies 104 is rotatably mounted via a fin axle 110 to a fin control mechanism 111 within the body 102 through openings 112 in the body 102. The trajectory of the projectile 100 may be affected by actuating the fin control mechanism to rotatably position the fin assemblies 104, thus causing the projectile 100 to roll, pitch, and/or yaw as desired. The fin control mechanism 111 may be any suitable fin control mechanism known to the art.

Figure 3:
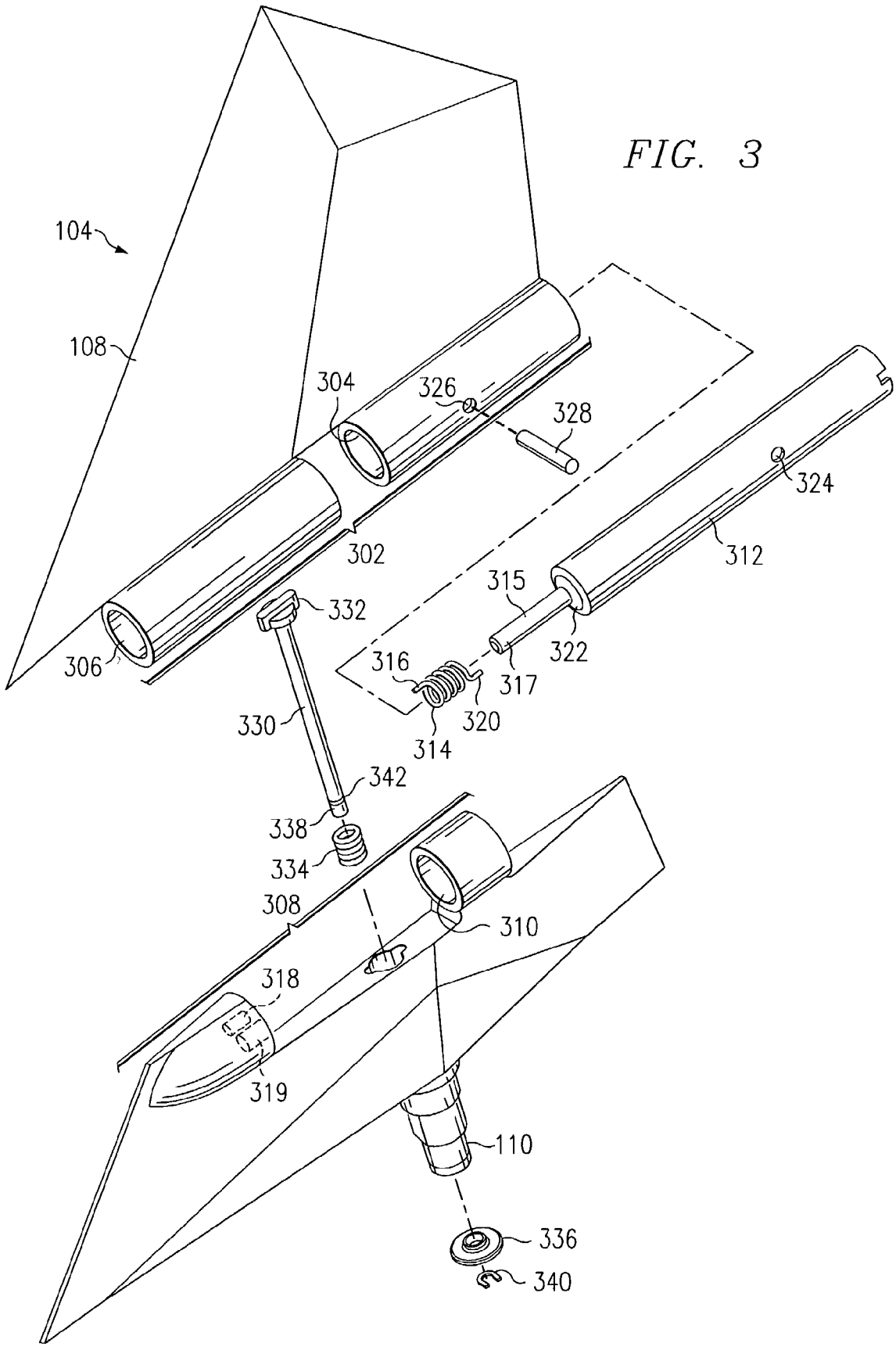
FIG. 3 is an exploded, perspective view of the fin assembly depicted in FIG. 2.
Figure 4:
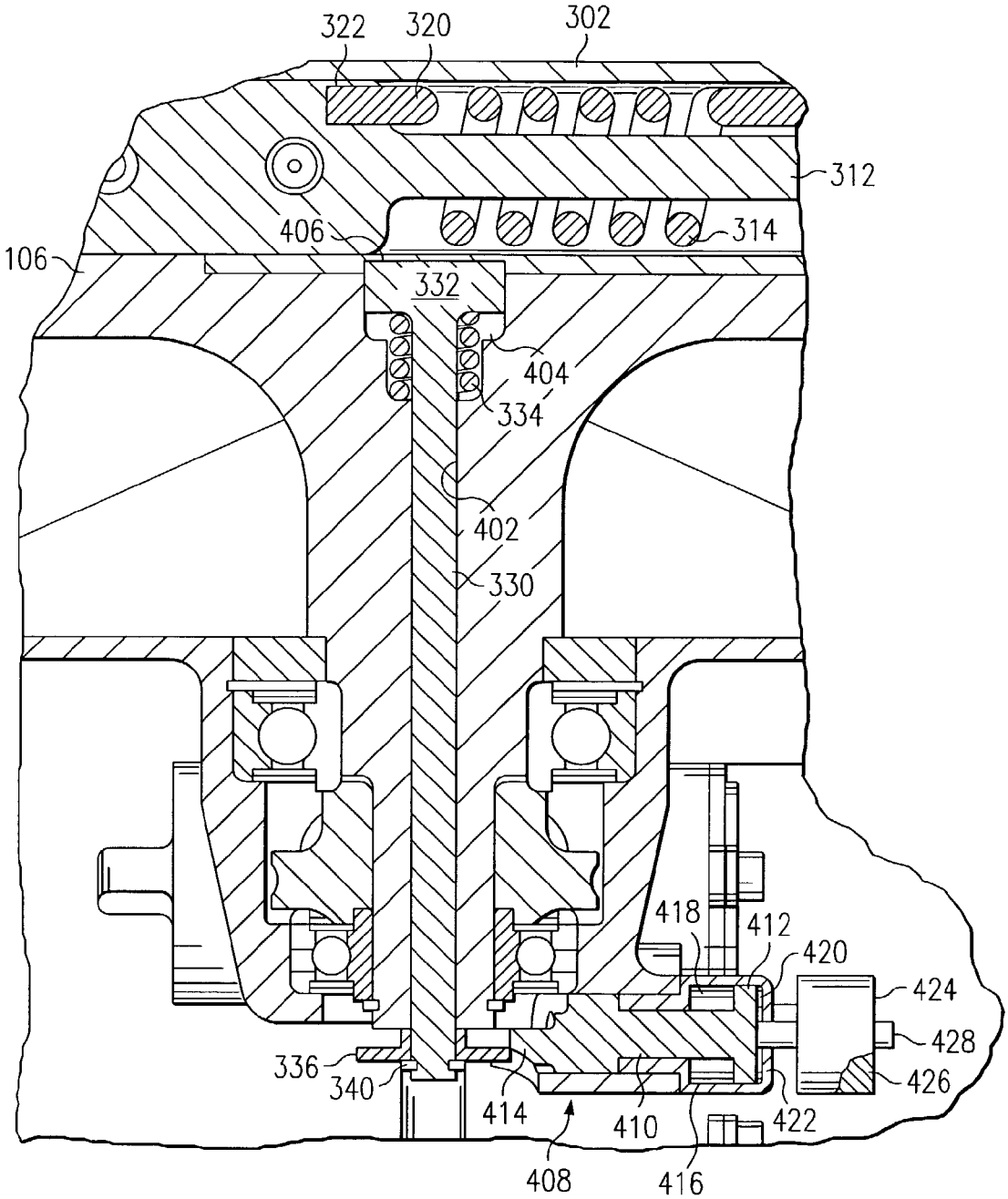
FIG. 4 is a cross-sectional view of a portion of the fin assembly shown in FIGS. 2 and 3 in a folded configuration.
Figure 5:
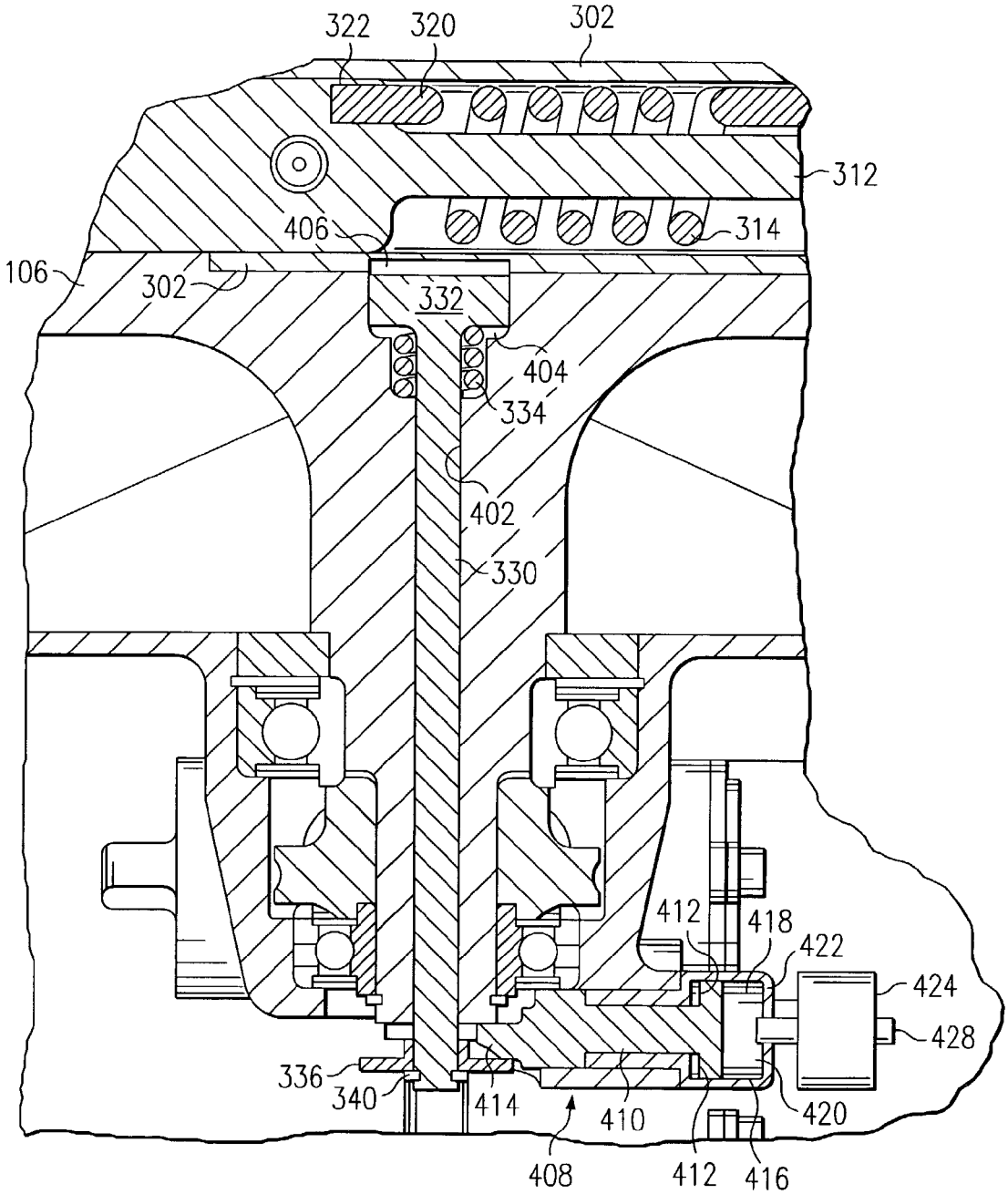
FIG. 5 is a cross-sectional view of a portion of the fin assembly shown in FIGS. 2 and 3 in an unfolded, operational configuration.

As indicated previously, it is generally desirable for each of the fin assemblies 104 to be stowed in a folded configuration (as illustrated in FIG. 1) and, upon deployment of the projectile 100, for each of the fin assemblies 104 to unfold into the operational configuration illustrated in FIG. 2. FIGS. 3–5 illustrate an embodiment of a selectively operable lock operably coupled to the fin base and the fin tip according to the present invention for locking the fin assembly 104 in a first chosen configuration, such as the folded configuration, and, upon deployment, for unlocking the fin assembly 104 so that it may unfold into a second chosen configuration, such as the operational configuration.

Referring now to FIG. 3, the fin tip 108 includes a hinge portion 302 defining bores 304, 306 therein. The fin base 106 includes a hinge portion 308, complementary to the hinge portion 302 of the fin tip 106, defining a bore 310 therein. When the hinge portion 302 of the fin tip 108 is mated with the hinge portion 308 of the fin base 106, the bores 304, 306, 310 are aligned, a hinge pin 312, with a reduced diameter portion 315 of the hinge pin 312 disposed through a torsion spring 314, is inserted into the aligned bores 304, 306, 310 to hinge the tin tip 108 to the fin base 106. A tip 317 of the reduced portion 315 is disposed within a bore 319 defined by the fin base 106.

Still referring to FIG. 3, when disposed within the bore 306, a first end 316 of the torsion spring 314 is received in a spring bore 318 defined by the hinge portion 308 and a second end 320 of the torsion spring 314 is received in a spring bore 322 defined by the hinge pin 312. The hinge pin 312 further defines a pin bore 324 that, when disposed within the bore 304, may be aligned with a pin bore 326 defined by the hinge portion 302 of the fin tip 108. A pin 328 may be inserted into the pin bores 324, 326 to retain the hinge pin 312 in the bores 304, 306, 310, 319, to retain the torsion spring 314 within the bore 306, and to allow the torsion spring 314 to be mechanically loaded. In this way, the torsion spring 314 is linked with both the fin base 106 and the fin tip 108. The torsion spring 314 is loaded more greatly when the fin tip 108 is in the folded, stowed configuration (shown in FIG. 1) than when the fin tip 108 is in the unfolded, operational configuration (shown in FIG. 2). When the projectile 100 is deployed and the fin tip 108 is unlocked (as will be described later), the torsion spring 314 urges the fin tip 108 into the unfolded, operational configuration.

As illustrated in FIG. 3, a locking rod 330 having a cross-member 332 is disposed through a helical spring 334, and the locking rod 330 and the helical spring 334 are disposed within the fin base 106. A pad 336 is held in a position near a lower end 338 of the locking rod 330 by a retaining clip 340 adapted to fit within a groove 342 of the locking rod 330. The invention, however, is not so limited, as any desired means may be used to hold the pad 336 in its position near the lower end 338 of the locking rod 330. Further, the pad 336 may be integral with the locking rod 330.

Referring to FIGS. 4 and 5, the locking rod 330 is slidably disposed within a bore 402 and a counterbore 404 receives the cross-member 332 and the helical spring 334. FIG. 4 illustrates the fin assembly 104 in a folded, stowed configuration (as illustrated in FIG. 1) and FIG. 5 shows the fin assembly 104 in an unfolded, operational configuration (as illustrated in FIG. 2). In the folded configuration, the helical spring 334 urges the cross-member 332 into a slot 406 in the hinge portion 302 of the fin tip 108. Upon or shortly after deployment of the projectile 100, an actuator 408 engages the pad 336, urging the locking rod 330 to slide relative to the bore 402 and withdrawing the cross-member 332 from the slot 406, as depicted in FIG. 5. With the cross-member 332 no longer in the slot 406, the fin tip 108 is urged by the torsion spring 314 to rotate relative to the fin base 106 into the unfolded configuration.

While the invention is not so limited, the actuator 408 in the illustrated embodiment includes a piston 410, having a head 412 and a tip 414, extending from a case 416. The head 412 is disposed within a cylinder 418 such that, when a fluid is introduced into a volume 420 of the cylinder 418 between the head 412 and a cylinder wall 422, the actuator 408 is triggered, resulting in the piston 410 being further extended from the case 416. In one embodiment, the fluid introduced into the volume 420 is a gas produced by firing an explosive squib 426. In one embodiment, the squib 426 is fired by firing an igniter 428, thus igniting an explosive material 424 within the squib 426. The invention, however, encompasses the fluid being produced by any desired fluid source. As the piston 410 extends from the case 416, the tip 414 contacts the pad 336, withdrawing the cross-member 332 of the locking rod 330 from the slot 406.

While the illustrated embodiment includes the torsion spring 314 to urge the fin tip 108 into an unfolded configuration and the helical spring 334 to urge the cross-member 332 into the slot 406, the invention is not so limited. Any biasing members, including various types of springs, may be used to urge the fin tip into an unfolded configuration and to urge the cross-member 332 into the slot 406.

While the locking rod 330 has been described herein to lock the fin assembly 104 in a folded configuration, the invention is not so limited. The actuator 408 may be engaged with the pad 336 then released, so that the locking rod 330 is urged into the slot 406 of the fin tip 108 to lock the fin assembly 104 in a chosen configuration, such as in an unfolded, operational configuration. Thus, the present invention encompasses the selectively operable lock being capable of locking the fin assembly 104 in any chosen configuration.

This concludes the description of the invention. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A fin assembly, comprising:

a fin base having an axle configured to extend through an opening of a vehicle;

a fin tip rotatably connected with the fin base; and means for selectively locking the fin tip in a chosen configuration, wherein the means for selectively locking the fin tip further comprises a locking rod selectively engageable with the fin tip and an actuator for disengaging the locking rod from the fin tip.

2. A fin assembly, according to claim 1, wherein the means for selectively locking the fin tip further comprises an explosive squib for driving the actuator.

3. A fin assembly, according to claim 1, wherein the means for selectively locking the fin tip further comprises a fluid source and the actuator further comprises:

a case having a cylinder wall and defining a cylinder therein in fluid communication with the fluid source; and a piston slidably disposed within the cylinder and including a head, such that, as fluid is introduced into the cylinder between the head and the cylinder wall, the piston engages the locking rod to disengage the locking rod from the fin tip.

4. A fin assembly, according to claim 1, wherein the means for selectively locking the fin tip further comprises a fluid source and a pad attached to the locking rod, wherein the actuator further comprises:

a case having a cylinder wall and defining a cylinder therein in fluid communication with the fluid source; and a piston slidably disposed within the cylinder and including a head, such that, as fluid is introduced into the cylinder between the head and the cylinder wall, the piston engages the pad to disengage the locking rod from the fin tip.

5. A fin assembly, comprising:

a fin base having an axle configured to extend through an opening of a vehicle;

a fin tip rotatably connected with the fin base; and a selectively operable lock operably coupled to the fin base and the fin tip, and capable of locking the fin assembly in a chosen configuration, wherein the selectively operable lock comprises a locking rod selectively engageable with the fin tip and an actuator for disengaging the locking rod from the fin tip.

6. A fin assembly, according to claim 5, wherein the selectively operable lock further comprises an explosive squib for driving the actuator.

7. A fin assembly, according to claim 5, wherein the selectively operable lock further comprises a fluid source and the actuator further comprises:

a case having a cylinder wall and defining a cylinder therein in fluid communication with the fluid source; and a piston slidably disposed within the cylinder and including a head, such that, as fluid is introduced into the cylinder between the head and the cylinder wall, the piston engages the locking rod to disengage the locking rod from the fin tip.

8. A fin assembly, according to claim 5, wherein the selectively operable lock further comprises a fluid source and a pad attached to the locking rod, wherein the actuator further comprises:

a case having a cylinder wall and defining a cylinder therein in fluid communication with the fluid source; and a piston slidably disposed within the cylinder and including a head, such that, as fluid is introduced into the cylinder between the head and the cylinder wall, the piston engages the pad to disengage the locking rod from the fin tip.

9. A vehicle, comprising:

a body defining a cavity therein and defining an opening through a wall thereof;

a fin control mechanism disposed within the cavity;

a fin base having an axle extending through the opening and engaged with the fin control mechanism;

a fin tip rotatably connected with the fin base;

means for selectively locking the fin tip in a chosen configuration; and means for urging the fin tip from a folded configuration into an unfolded configuration, wherein the means for selectively locking the fin tip further comprises a locking rod selectively engageable with the fin tip and an actuator for disengaging the locking rod from the fin tip.

10. A vehicle, according to claim 9, wherein the means for selectively locking the fin tip further comprises an explosive squib for driving the actuator.

11. A vehicle, according to claim 9, wherein the means for selectively locking the fin tip further comprises a fluid source and the actuator further comprises:

a case having a cylinder wall and defining a cylinder therein in fluid communication with the fluid source; and a piston slidably disposed within the cylinder and including a head, such that, as fluid is introduced into the cylinder between the head and the cylinder wall, the piston engages the locking rod to disengage the locking rod from the fin tip.

12. A vehicle, according to claim 9, wherein the means for selectively locking the fin tip further comprises a fluid source and a pad attached to the locking rod, wherein the actuator further comprises:

a case having a cylinder wall and defining a cylinder therein in fluid communication with the fluid source; and a piston slidably disposed within the cylinder and including a head, such that, as fluid is introduced into the cylinder between the head and the cylinder wall, the piston engages the pad to disengage the locking rod from the fin tip.

13. A method for configuring a fin assembly on a vehicle, comprising:

providing a fin tip rotatably connected with a fin base, the fin base having an axle extending through an opening of the vehicle;

selectively locking the fin tip in a first position relative to the fin base;

selectively unlocking the fin tip; and rotating the fin tip to a second position relative to the fin base, wherein selectively unlocking the fin tip further comprises selectively disengaging a locking rod from the fin tip.

14. A method, according to claim 13, wherein selectively unlocking the fin tip further comprises driving an actuator to selectively disengage the locking rod from the fin tip.

15. A method, according to claim 14, wherein driving the actuator further comprises firing an explosive squib to drive the actuator.

16. A method, according to claim 14, wherein selectively unlocking the fin tip further comprises:

introducing a fluid into a piston-type actuator; and engaging a portion of the actuator with a pad of the locking rod.

17. An apparatus, comprising:

a fin tip rotatably connected with a fin base, the fin base having an axle extending through an opening of a vehicle;

means for selectively locking the fin tip in a first position relative to the fin base;

means for selectively unlocking the fin tip; and means for rotating the fin tip to a second position relative to the fin base, wherein the means for selectively unlocking the fin tip further comprises means for selectively disengaging a locking rod from the fin tip.

18. An apparatus, according to claim 17, wherein the means for selectively unlocking the fin tip further comprises means for driving an actuator to selectively disengage the locking rod from the fin tip.

19. An apparatus, according to claim 18, wherein the means for driving the actuator further comprises means for firing an explosive squib to drive the actuator.

20. An apparatus, according to claim 18, wherein the means for selectively unlocking the fin tip further comprises:

means for introducing a fluid into a piston-type actuator; and means for engaging a portion of the actuator with a pad of the locking rod.

* * * * *